US006517011B1

(12) United States Patent
Ayanji et al.

(10) Patent No.: US 6,517,011 B1
(45) Date of Patent: Feb. 11, 2003

(54) FUEL INJECTOR WITH PRESSURIZED FUEL REVERSE FLOW CHECK VALVE

(75) Inventors: Sudhindra K. Ayanji, Peoria, IL (US); Ye Tian, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 36 days.

(21) Appl. No.: 09/593,027

(22) Filed: Jun. 13, 2000

(51) Int. Cl.[7] ..... B05B 9/00

(52) U.S. Cl. ..... 239/124; 239/90; 239/533.8; 137/533.17

(58) Field of Search ..... 239/124, 88–92, 239/533.1, 533.11, 96; 137/516.15, 516.17, 533, 533.17; 123/467, 470

(56) References Cited

U.S. PATENT DOCUMENTS 4,104,992 A * 8/1978 Fricker ..... 123/467
4,200,231 A * 4/1980 Knape ..... 239/533.8
4,392,612 A 7/1983 Deckard et al.
4,527,738 A 7/1985 Martin
4,561,590 A * 12/1985 Akagi ..... 239/96
4,565,320 A 1/1986 Taniguchi et al.
5,121,730 A 6/1992 Ausman et al.
5,287,838 A 2/1994 Wells
5,328,094 A * 7/1994 Goetzke et al. ..... 239/88
5,429,309 A * 7/1995 Stockner ..... 239/533.8
5,797,427 A * 8/1998 Buescher ..... 137/533.17

* cited by examiner

*Primary Examiner*—Henry C. Yuen
*Assistant Examiner*—Dinh Q. Nguyen
(74) *Attorney, Agent, or Firm*—Eric M Bram; Mike R Huber

(57) ABSTRACT

A fuel injector pressurizes fuel in a pressurization chamber and ejects the fuel from an orifice. A reverse flow check valve allows fluid communication between the pressurization chamber and the orifice during fuel injection, but blocks fluid communication between the pressurization chamber and the orifice when fuel pressure in the pressurization chamber decreases.

6 Claims, 4 Drawing Sheets

FUEL INJECTOR WITH PRESSURIZED FUEL REVERSE FLOW CHECK VALVE

TECHNICAL FIELD

This invention relates generally to unit fuel injectors that perform cyclic fuel pressurization, and more particularly to reverse flow check valves in unit fuel injectors.

BACKGROUND ART

Reverse flow check valve assemblies for unit fuel pump-injectors are known, for example U.S. Pat. No. 4,527,738 to Martin issued Jul. 9, 1985, U.S. Pat. No. 4,392,612 to Deckard et al. issued Jul. 12, 1983, and U.S. Pat. No. 5,287,838 to Wells issued Feb. 22, 1994. The function of such check valve assemblies is generally to permit communication of high pressure fuel from a pressurization chamber to a nozzle chamber during an injection phase, and to prevent fluid communication (i.e., reverse flow) of engine cylinder combustion gas from the injection nozzle to the pressurization chamber during a non-injection phase.

The check valve assemblies of Martin and Deckard each include a movable one-way flow check in the form of an imperforate plate, positioned at the end of or adjacent to pressurization sections of their respective fuel injectors. A flow path for pressurized fuel during injection is defined by an annular clearance between the outer periphery of the check and a wall of a bore in which the check is positioned.

With these reverse flow check valve assemblies the plate must be relatively loose in its bore, providing a relatively large clearance in order to provide a cross-sectional flow area that permits sufficient injection fuel flow. One problem that may occur with the relatively loose annular clearance is that the movable check may become cocked or tilted in its bore. Undesirable wear results as the cocked check moves back and forth between upper and lower seats.

Another problem with the above check valve assemblies is that they may not fit in some unit fuel pump-injectors if space is limited. For example, U.S. Pat. No. 5,121,730 to Ausman et al. issued Jun. 16, 1992, and the patent to Wells, illustrate that available space for a reverse flow check valve assembly beneath the pressurization chamber may be limited and would have to be offset with respect to the pressurization chamber axis due to the location and proximity of a fuel inlet check leading to the pressurization chamber. Wells also addresses the problem of "cocking" by adding a central hole in the flow check.

In order to provide a reverse flow check valve for the pump-injector of Ausman et al. using a reverse flow check valve similar to those shown in Martin or Deckard et al., the displacement or lift of the check may have to be increased to provide sufficient fuel flow. Such an increase in lift may prevent such reverse flow check valve assemblies from fitting within the limited space available. In the reverse flow check valve assembly taught by Wells, space constraints cause the upper stop to be thin, which could cause structural weakness.

The invention is directed to addressing one or more of the above topics.

DISCLOSURE OF THE INVENTION

In one aspect of the invention, a fuel injector comprises a pressurization section and a nozzle section. The pressurization section at least partially defines a variable-volume pressurization chamber. The nozzle section has a check bore, a nozzle chamber, an orifice, a fuel injection check extending into the nozzle chamber, and a reverse flow check valve fluidly connected with the nozzle chamber.

The fuel injection check is slidably disposed in the check bore between a first position that blocks fluid communication between the nozzle chamber and the orifice and a second position that opens fluid communication between the nozzle chamber and the orifice. A fuel passage fluidly connects the pressurization chamber in the pressurization section with the reverse flow check valve in the nozzle section.

The reverse flow check valve includes a perforated reverse flow check hydraulically movable between an open position that allows fluid communication from the fuel passage to the nozzle chamber and a closed position that denies fluid communication from the nozzle chamber to the fuel passage.

In a second aspect of the invention, a fuel injector comprises a variable-volume pressurization chamber, a nozzle including a nozzle chamber and an orifice, and a reverse flow check valve including a reverse flow check and a column extending through a perforation in the reverse flow check. The reverse flow check is movable between an open position providing fluid communication between the pressurization chamber and the nozzle chamber, and a closed position that blocks fluid communication between the pressurization chamber and the nozzle chamber.

In a third aspect of the invention, a fuel injection method comprises pressurizing fuel in a pressurization chamber within a fuel injector, injecting the pressurized fuel by opening a flow path between the pressurization chamber and an orifice in the fuel injector, and hydraulically moving a reverse flow check axially along a column that extends through a perforation in the reverse flow check to a closing position to close the flow path while fuel injection is not taking place. Opening the flow path comprises hydraulically moving the reverse flow check away from the closing position.

BRIEF DESCRIPTION OF THE DRAWINGS

Features of the invention can be better understood with reference to the drawing figures, in which certain features may be repositioned and certain dimensions may be exaggerated to better explain the invention, and in which.

BEST MODE FOR CARRYING OUT THE INVENTION

The invention is now described with reference to FIGS. 1–4, which illustrate three embodiments of fuel injectors 12 comprising a reverse flow check valve 34 according to the invention.

Figure 1:
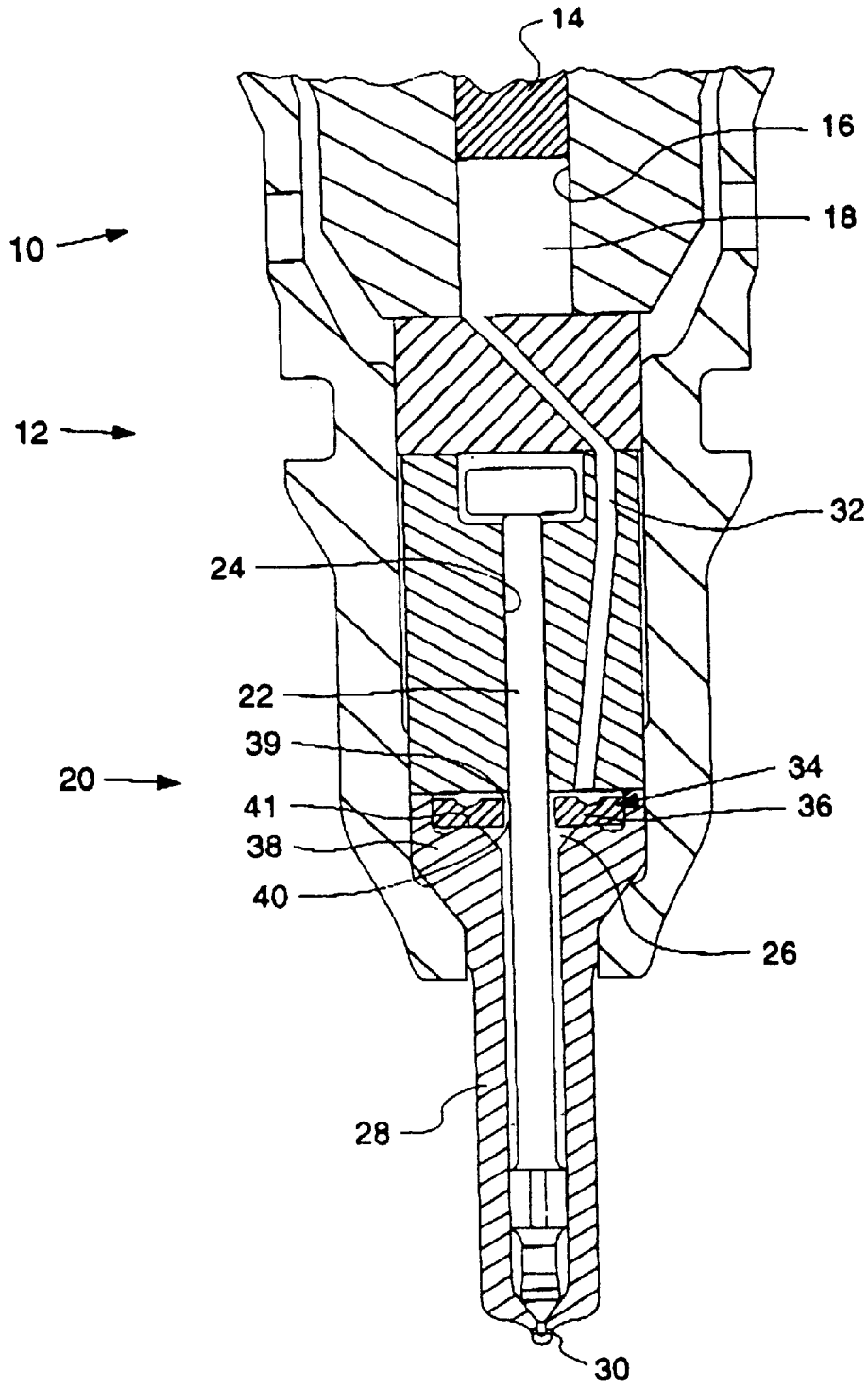
FIG. 1 is a diagrammatic side view representation of a reverse flow check valve according to a first embodiment of the invention.

In a first embodiment, shown in FIG. 1, in a pressurization section 10 of a fuel injector 12 a plunger 14 and a plunger bore 16 define a variable-volume pressurization chamber 18. In a nozzle section 20 of the fuel injector 12 an injection check 22 is slidably disposed in a check bore 24 and extends into a nozzle chamber 26 in a nozzle 28 having an orifice 30 for injecting fuel from the fuel injector 12. The pressurization chamber 18 and the nozzle chamber 26 are fluidly connected via a fuel passage 32 and a reverse flow check valve 34 comprising a ring-shaped, perforated reverse flow check 36 and the space immediately around it.

In the first embodiment the reverse flow check valve 34 is movable within the nozzle chamber 26 in a lower block 38 of the nozzle section 20. The reverse flow check 36 in this embodiment is ring-shaped, with a rectangular cross-section, and has a perforation 39. The injection check 22 extends through the perforation 39. The injection check 22 has a smaller diameter than the perforation 39, leaving a clearance 40 between the reverse flow check 36 and the injection check 22. In an open position (illustrated) the reverse flow check 36 is disposed against a wall 41 of the nozzle chamber 26.

Figure 2:
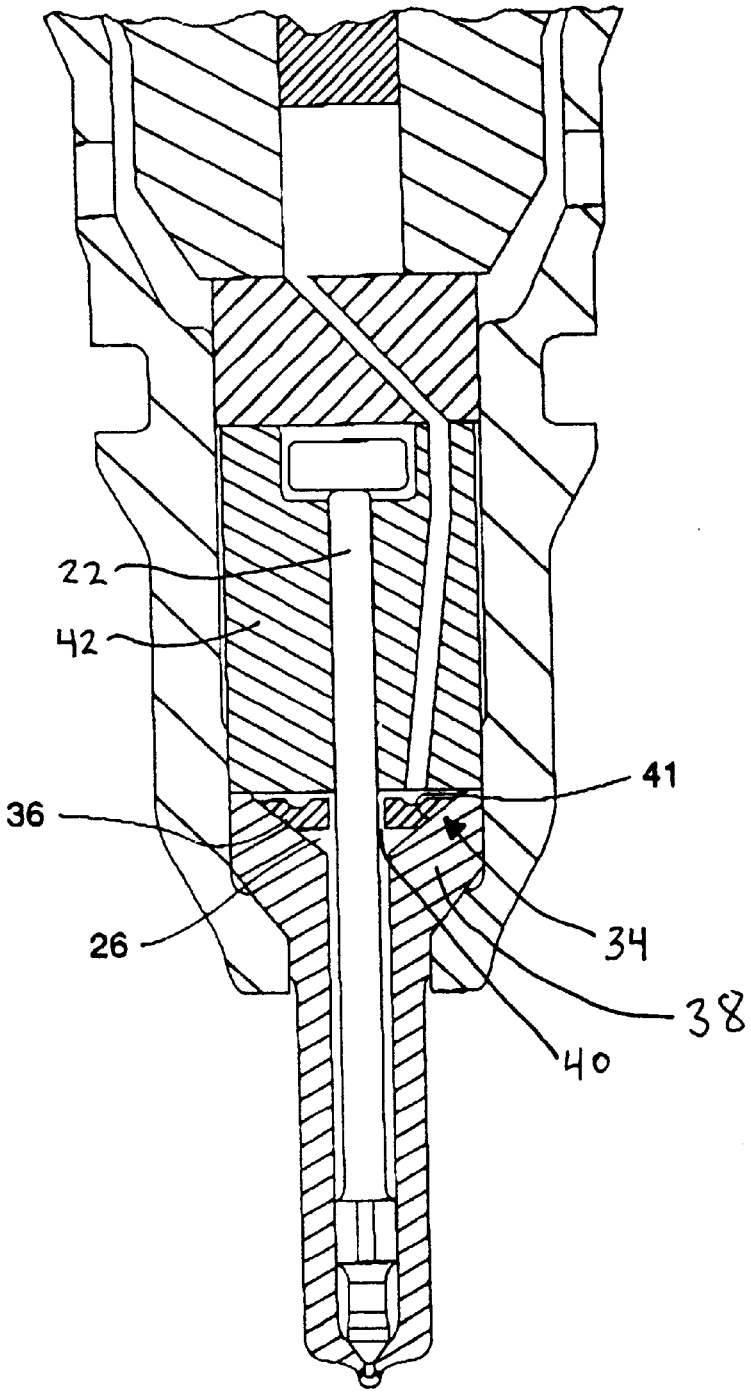
FIG. 2 is a diagrammatic side view representation of a reverse flow check valve according to a second embodiment of the invention.

A second embodiment, shown in FIG. 2 is similar to the first embodiment, with the reverse flow check 36 having a different cross-section. In an open position (illustrated) the reverse flow check 36 is disposed against a wall 41 of the nozzle chamber 26.

Figure 3:
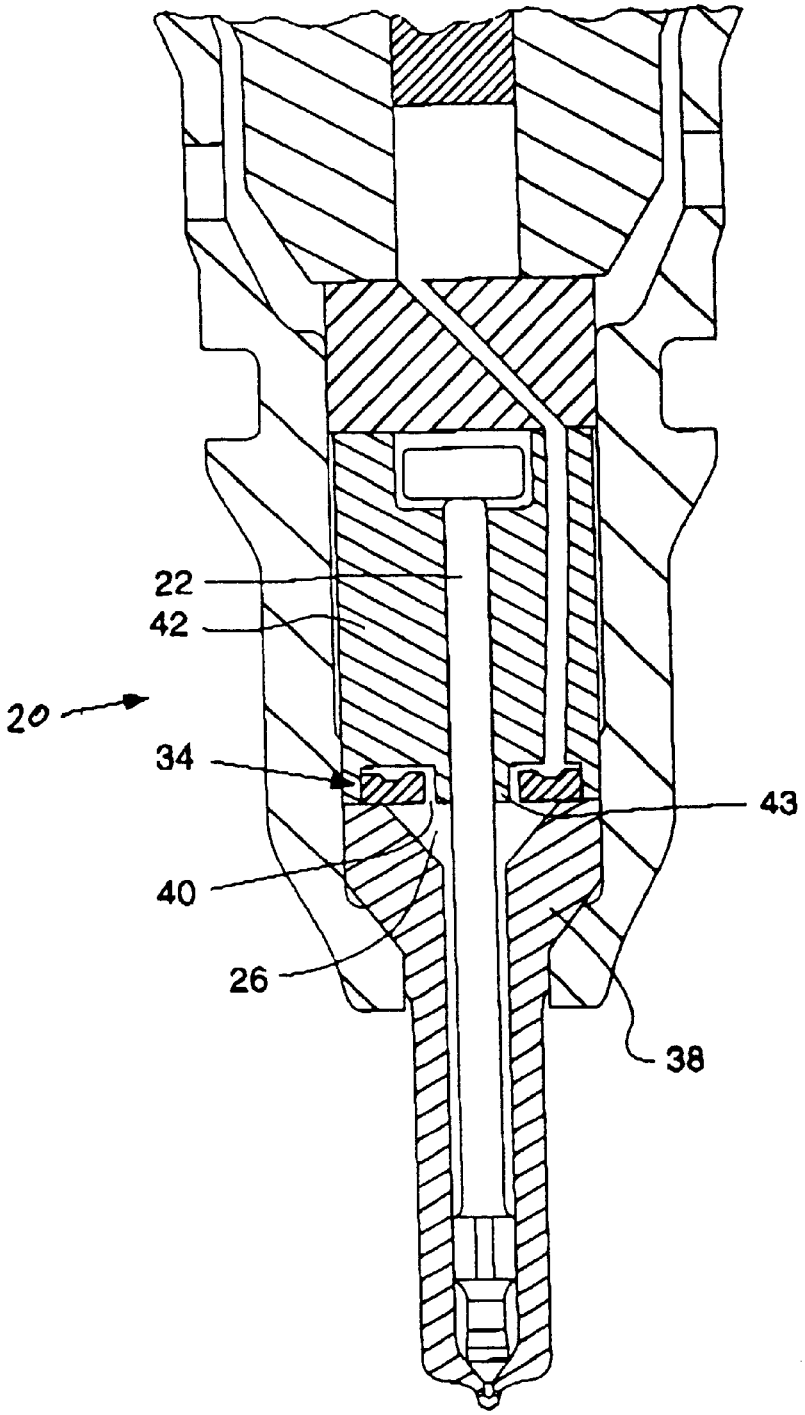
FIG. 3 is a diagrammatic side view representation of a reverse flow check valve according to a third embodiment of the invention.

A third embodiment, shown in FIG. 3 is similar to the first embodiment, but with the reverse flow check valve 34 in an upper block 42 of the nozzle section 20 and adjacent to the nozzle chamber 26, instead of in the nozzle chamber 26 proper. In this embodiment the reverse flow check 36 and the clearance 40 surround a sleeve 43 portion of the upper block 42. In an open position (illustrated) the reverse flow check 36 is disposed against the lower block 38. In other embodiments (not shown) the reverse flow check valve 34 can be in an upper block 42 as in this embodiment, but directly surrounding the injection check 22 as in FIGS. 1 and 2.

Figure 4:
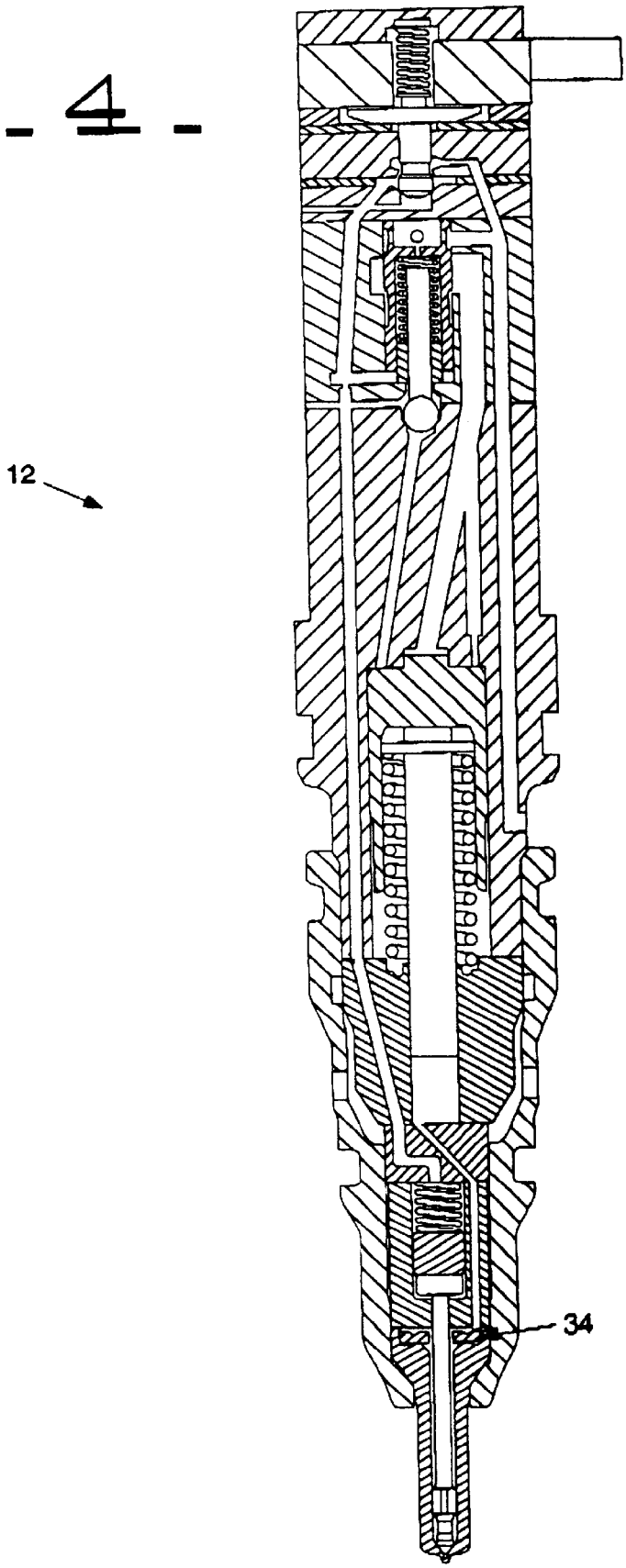
FIG. 4 is a diagrammatic side view representation of a fuel injector comprising a reverse flow check valve according to the invention.

An embodiment of a fuel injector 12 utilizing the invention is shown in FIG. 4.

INDUSTRIAL APPLICABILITY

With reference to FIG. 1, the plunger 14 moves down in the plunger bore 16, pressurizing fuel in the pressurization chamber 18. The pressurized fuel flows through the fuel passage 32 into the reverse flow check valve 34, where it pushes the reverse flow check 36 downward so the pressurized fuel can pass through the clearance 40 into the nozzle chamber 26. The dimple in the upper face of the reverse flow check 36 in the illustrated embodiment increases flow area to more evenly distribute pressure over the face of the reverse flow check 36, to keep the reverse flow check 36 more stable and its motion more uniform. Fuel injection commences when the injection check 22 slides upward in its bore 24 from a first position that blocks fluid communication between the nozzle chamber 26 and the orifice 30, to a second position that opens fluid communication between the nozzle chamber 26 and the orifice 30.

When the plunger 14 begins to withdraw, pressure drops in the pressurization chamber 18 and hence in the fuel passage 32. Higher pressure in the nozzle chamber 26 pushes the reverse flow check 36 axially along the column of the injection check 22 until it pushes against the upper block 42, closing off fluid communication between the nozzle chamber 26 and the fuel passage 32. This blocks low-pressure fuel and/or high-pressure cylinder gas, that may have leaked in through the orifice 30 from outside the fuel injector 12, from entering the fuel passage 32 and hence the pressurization chamber 18.

Since the reverse flow check 36 can be pushed closed by high-pressure liquid (i.e., fuel), gas (i.e., combustion gases), or a combination thereof, it can be considered hydraulically and/or pneumatically movable. However, for ease of reference for the purposes of this application "fluid" signifies either liquid or gas, or a combination thereof, and "hydraulically movable", "hydraulically moving", and "hydraulically pushing" refer to movement or force caused by liquid pressure, gas pressure, or a combination thereof.

Outside walls of the reverse flow check 36 can be tapered as in FIG. 2 to center the reverse flow check 36 when it is pushed downward during fuel pressurization, to assure more uniform distribution of the clearance 40 about the injection check 22.

In the embodiments of FIGS. 1–3, because the reverse flow check 36 is disposed around the injection check 22 or the sleeve 43, upward forces in the nozzle chamber 26 against the reverse flow check 36 are radially symmetrical so the reverse flow check 36 is less likely to get "cocked," even when the reverse flow check 36 is made very small. The injection check 22 and the sleeve 43 thus act as support members for the reverse flow check 36.

The invention can be used in various types of fuel injectors having cyclic fuel pressurization, with or without direct check control, using hydraulic or mechanical actuation, etc. A sample hydraulically actuated fuel injector with direct check control is shown utilizing the invention in FIG. 4.

Many variations of the invention are possible. For example, embodiments could be constructed with minimal clearance between the reverse flow check 36 and the injection check 22 or sleeve 43, using an additional perforation in the reverse flow check 36, or even a clearance around the outside of the reverse flow check 36, for fuel flow between the pressurization chamber 18 and the nozzle chamber 26 when the reverse flow check 36 is in the open position.

Accordingly, while the invention has been illustrated and described in detail in the drawings and foregoing description, such illustration and description are to be considered illustrative or exemplary and not restrictive; other variations to the disclosed embodiments can be made by those skilled in the art while practicing the claimed invention from a study of the drawings, the disclosure, and the appended claims.

We claim:

1. A fuel injector comprising:

a pressurization section at least partially defining a variable-volume pressurization chamber;

a nozzle section having a check bore, a nozzle chamber, an orifice, a fuel injection check extending into the nozzle chamber and being slidably disposed in the check bore between a first position that blocks fluid communication between the nozzle chamber and the orifice and a second position that opens fluid communication between the nozzle chamber and the orifice, and a reverse flow check valve fluidly connected with the nozzle chamber; and a fuel passage fluidly connecting the pressurization chamber in the pressurization section with the reverse flow check valve in the nozzle section, the reverse flow check valve including a perforated reverse flow check hydro-pneumatically movable between an open position that allows fluid communication from the fuel passage to the nozzle chamber and a closed position that denies fluid communication from the nozzle chamber to the fuel passage; and wherein the fuel injection check extends through a perforation in the reverse flow check valve.

2. The fuel injector of claim 1, wherein the reverse flow check is ring-shaped.

3. The fuel injector of claim 1, the reverse flow check valve further including a clearance between the reverse flow check and the fuel injection check.

4. The fuel injector of claim 3, wherein said clearance fluidly connects the pressurization chamber with the nozzle chamber when the reverse flow check is in said open position.

5. The fuel injector of claim 1, wherein the reverse flow check is ring-shaped with a central perforation, and a column extends through the central perforation in the reverse flow check.

6. The fuel injector of claim 5, wherein said central perforation includes a clearance between the column and the reverse flow check that fluidly connects the pressurization chamber with the nozzle chamber when the reverse flow check is in said open position.

* * * * *